US005791365A

United States Patent [19]

Harbaugh

[11] Patent Number: 5,791,365

[45] Date of Patent: Aug. 11, 1998

[54] ESCUTCHEON PLATE

[76] Inventor: Steve Harbaugh, 2912 Tisinger Pl., Plano, Tex. 75075

[21] Appl. No.: 865,859

[22] Filed: May 30, 1997

[51] Int. Cl.[6] ..... F16L 5/00

[52] U.S. Cl. ..... 137/15; 137/359

[58] Field of Search ..... 137/359, 15

[56] References Cited

U.S. PATENT DOCUMENTS

| | | | |
|---|---|---|---|
| 1,543,511 | 6/1925 | Niedecken | 137/359 |
| 3,735,776 | 5/1973 | Graversen et al. | 137/359 |
| 4,502,165 | 3/1985 | Szemeredi et al. | 137/359 |
| 4,989,278 | 2/1991 | Kostorz | 137/359 |
| 5,263,853 | 11/1993 | Pall | 137/359 |
| 5,447,338 | 9/1995 | Kikuchi | 137/359 |

*Primary Examiner*—A. Michael Chambers
*Attorney, Agent, or Firm*—Martin Sachs

[57] ABSTRACT

A unitary (one-piece) escutcheon plate is formed by a flexible member provided with a central aperture and a radially extending cut permitting it to flex and be placed over a pipe without removing a fixture affixed thereon and may include indicia or adornment and be placed over an existing escutcheon plate, if desired.

16 Claims, 1 Drawing Sheet

ESCUTCHEON PLATE

BACKGROUND OF THE INVENTION

1. Field of the Invention

The present invention relates to escutcheon plates, and more particularly, to a unitary escutcheon plate which may be used after a plumbing fixture has been placed on a pipe exiting from a surface, without removing the fixture and may form a decorative cover for an existing escutcheon plate.

2. Discussion of the Relevant Art

When plumbing fixtures, such as shower heads, wash basins, bathtubs, toilet tanks, etc., are installed, it is necessary to bring water supply pipes and drain pipes through holes placed in a wall or floor. These holes are generally larger than the pipes which extend through the wall and floor and are somewhat irregular, presenting a poor appearance. Normally a cover is placed on the pipes so that the opening in the wall is hidden from view.

The prior art abounds with multiple types of escutcheon plates, such as that set forth in U.S. Pat. No. 4,366,866 awarded to Sweeney on Jan. 4, 1983, which provides a decorator surface about a sprinkler head. It is fabricated in two identical molded plastic parts in addition to a molded plastic shim. Another type of escutcheon plate is disclosed in U.S. Pat. No. 3,615,108 issued to Toth on Oct. 26, 1971, which is a one-piece member fabricated from a synthetic plastic material and has gripping fingers to affix it firmly on a pipe extending through a wall.

Many design patents, such as U.S. Pat. No. Des. 322,926 issued to Kolada, et al. on Jan. 7, 1992, which provides a one-piece ornamental design that is be placed on a pipe prior to the attachment of any fixture thereon. Many other one-piece escutcheon plates are disclosed in the prior art, all of which require that they be put in place prior to the installation of the fixtures or handles associated therewith. In U.S. Pat. No. Des. 356,362 issued to Bourgeois et al. on Mar. 14, 1995, there is disclosed a two-piece decorative escutcheon plate, which may be installed after a fixture handle has been affixed on a water pipe.

The present invention overcomes the shortcomings found in the prior art by providing a one-piece (unitary) escutcheon plate that may be used on a water pipe as it exits a flat wall or floor, before or after, the fixture or handle is affixed on the pipe or alternatively, it may be used for decorative purposes to cover an existing escutcheon plate without requiring the need to remove the fixture associated therewith.

Therefore, it is an object of the present invention to provide a one-piece or unitary escutcheon plate, which may be placed over a plumbing pipe where it exits a wall without the need for any tools.

It is another object of the present invention to provide a one-piece escutcheon, which may be placed over an existing escutcheon plate for decorative purposes.

It is yet another object of the present invention to provide an easily installable decorative escutcheon plate, which is inexpensive to manufacture.

SUMMARY OF THE INVENTION

In accordance with the present invention, an escutcheon plate is molded in one-piece (unitary) of synthetic flexible material, which is not subject to corrosion after many years of use. The material utilized may be metallic or plastic as long as it is sufficiently flexible to allow for the opening of a radially extending slit or cut to enable it to be placed over a pipe without using any tools. The instant escutcheon plate may be formed by a stamping process, a molding process or an extruding process by extruding the material with a curved extruding dye to come back upon itself, providing an overlaying portion including a locking means.

The foregoing and other objects and advantages will appear from the description to follow. In the description reference is made to the accompanying drawing, which forms a part hereof, and in which is shown by way of illustration a specific embodiments in which the invention may be practiced. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
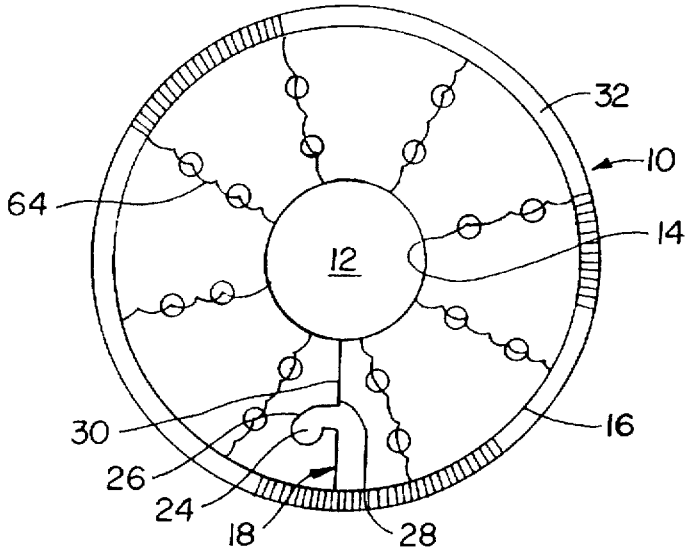
FIG. 1 is a top plan view of the escutcheon plate or cover, according to the principles of the present invention.
Figure 2:
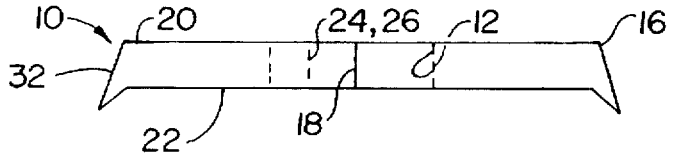
FIG. 2 is a cross-sectional view, in elevation, of the escutcheon plate shown in FIG. 1.

Referring now to the drawings, and in particular to FIGS. 1 and 2, there is shown an escutcheon plate 10 having a centrally disposed through aperture 12 providing an inner edge 14, an outer edge 16 and a radial through-cut or slit 18 extending from the inner edge 14 to the outer edge 16. Through-cut 18 extends from the top surface 20 to the bottom surface 22 of the escutcheon plate 10, as shown in FIG. 2. The through-cut 18 made to extend from the inner edge 14 to the outer edge 16 is provided with a hooked portion 24 thereby forming a mating receptacle or socket portion 26, which may be used to removably lock the first end 28 to the second end 30 of the escutcheon plate 10 together, once it has been inserted upon a pipe, not shown, running through aperture 12. If desired, an outwardly extending flange 32 may be provided on the escutcheon 10 in order to have it fit over an existing escutcheon plate, not shown.

Figure 3:
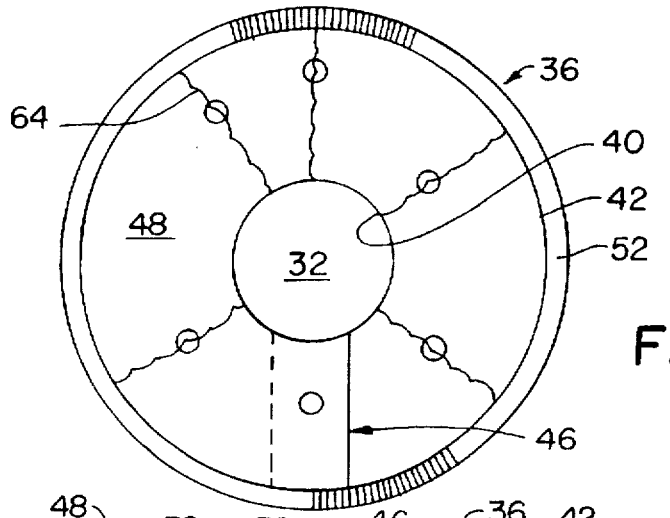
FIG. 3 is an alternative embodiment of an escutcheon plate, according to the principles of the present invention.
Figure 4:
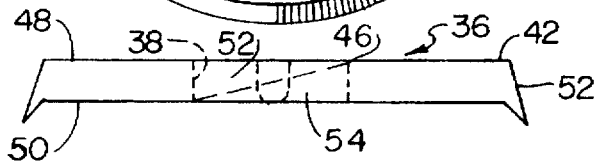
FIG. 4 is a cross-sectional view, in elevation, of the escutcheon plate shown in FIG. 3.

An alternative embodiment of the invention is shown in FIG. 3, which is a top plan view of the escutcheon plate 36. The central aperture 38 provides an inner edge 40 and an outer edge 42. A through-cut 46 extends from the inner edge 40 to the outer edge 42 and from the top surface 48 to the bottom surface 50, at an acute angle (preferably approximately 45 degrees) from the surface 48 to the surface 50. A flange 52 may also be provided around the outer edge 42 so that it may cover an existing escutcheon plate, not shown. The through-cut 46 includes a first end 52 and second end 54. The first end 52 is provided with a protruding portion 56 on its bottom edge 58 and the second end 54 is provided with a receptacle or dimple 60 on its top surface 62, suitable for receiving the protrusion 56 and to removably retain it therein.

Figure 5:
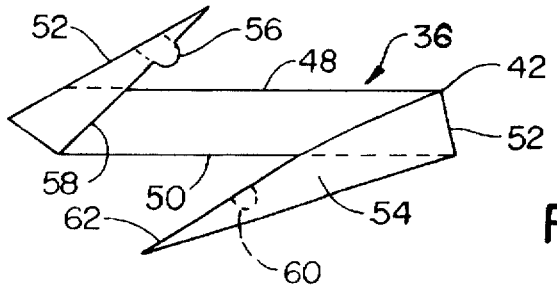
FIG. 5 is a cross-sectional view, in elevation, showing how the radial cut or slit may be opened to allow for the insertion of a water pipe.

In operation, the escutcheon plate 10 or 36 may be opened or flexed, as shown in FIG. 5, wherein it is in a position to receive a pipe, not shown, within the opening 12 or 38. Thereafter, the remaining portions 24 and 26 of escutcheon plate 10 and the remaining portions 56 and 60 of escutcheon plate 36 may be closed, locking the escutcheon plates 10 or 36 in position so that it surrounds the pipe. The top surface of the escutcheon plates 10 and 36 may include indicia or some other form of adornment 64 to make the escutcheon plates 10 and 36 more attractive to view.

Hereinbefore has been disclosed a one-piece (unitary) escutcheon plate suitable for use on a pipe exiting a wall, a floor or a ceiling, which may be attached without removing a fixture associated therewith.

It will be understood that various changes in the details, materials, arrangements of parts and operating conditions which have been herein described and illustrated in order to explain the nature of the invention may be made, by those skilled in the art, within the principles and scope of the instant invention.

Having thus set forth the nature of the invention, what is claimed is:

1. The method of making a unitary escutcheon plate comprising the steps of:

A. providing a flexible extrudable material;

B. extruding said material in a continuous arc so that a said material comes back upon itself; and C. providing means to lock the open ends together.

2. A unitary escutcheon plate suitable for placement on a pipe where it exits a surface, without removing a fixture affixed thereon, comprising:

A. a generally flat, flexible, unitary member having a top surface and a bottom surface, including;

a) a through aperture, b) an inner edge, c) an outer edge d) a through-cut extending from said top surface to said bottom surface and from said inner edge to said outer edge forming a first and second end, and e) an extending portion disposed on said first end and a corresponding mating portion disposed on said second end for removably locking said first and second ends together.

3. A unitary escutcheon plate, according to claim 2, further including an extending lip portion disposed about said outer edge.

4. A unitary escutcheon plate, according to claim 2, further including indicia disposed upon said top surface.

5. A unitary escutcheon plate, according to claim 2, further including adornment disposed upon said top surface.

6. A unitary escutcheon plate, according to claim 2, wherein said through-cut extends from said top surface to said bottom surface perpendicular to the planes of said top and bottom surface.

7. A unitary escutcheon plate, according to claim 2, wherein said through-cut extends from said top surface to said bottom surface at an acute angle to the planes of said top and bottom surface.

8. A unitary escutcheon plate, according to claim 7, wherein said corresponding mating portion disposed on said second end is an aperture.

9. A unitary escutcheon plate, according to claim 7, wherein said corresponding mating portion disposed on said second end is a dimple.

10. A unitary escutcheon plate, according to claim 7, wherein said extending portion is a protuberance and said mating portion is an aperture.

11. A unitary escutcheon plate, according to claim 7, wherein said through-cut extends from said top surface to said bottom surface at an acute angle of approximately 45 degrees to the planes of said top and bottom surface.

12. A unitary escutcheon plate suitable for placement on a pipe where it exits a surface, without removing a fixture affixed thereon, comprising:

A. a generally flat, flexible, unitary member having a top surface and a bottom surface, including;

a) a through aperture, b) an inner edge, c) an outer edge d) a through cut extending from said inner edge to said outer edge forming a first and second end, said through cut extending from said top surface to said bottom surface perpendicular to the planes of said top and bottom surface, and e) an extending portion disposed on said first end and a corresponding mating portion disposed on said second end for removably locking said first and second ends together.

13. A unitary escutcheon plate, according to claim 12, further including adornment disposed upon said top surface.

14. A unitary escutcheon plate, according to claim 12, further including indicia disposed upon said top surface.

15. A unitary escutcheon plate, according to claim 12, wherein said corresponding mating portion disposed on said second end is an aperture.

16. A unitary escutcheon plate, according to claim 12, wherein said extending portion is a protuberance and said mating portion is an aperture.

* * * * *